US005915441A

United States Patent [19]

Schlack

[11] Patent Number: 5,915,441

[45] Date of Patent: Jun. 29, 1999

[54] DUAL PIVOT HINGE ASSEMBLY

[75] Inventor: Richard E. Schlack, Rising Sun, Md.

[73] Assignee: Southco, Inc., Concordville, Pa.

[21] Appl. No.: 08/943,883

[22] Filed: Oct. 3, 1997

[51] Int. Cl.[6] ..... E05D 11/06; E05D 11/10

[52] U.S. Cl. ..... 16/371; 16/366; 16/334

[58] Field of Search ..... 16/366, 368, 369, 16/371, 374, 376, 302, 303, 304, 329, 331, 332, 334

[56] References Cited

U.S. PATENT DOCUMENTS

| | | | |
|---|---|---|---|
| 2,843,873 | 7/1958 | Slower | 16/303 |
| 4,928,350 | 5/1990 | Morgan | 16/376 |
| 5,493,760 | 2/1996 | Takimoto | 16/366 |
| 5,561,887 | 10/1996 | Neag et al. . | |
| 5,632,065 | 5/1997 | Siladke et al. | 16/335 |
| 5,685,046 | 11/1997 | Neag et al. | 16/366 |

OTHER PUBLICATIONS

Emka Handbook, 1997, two pages re: "180 Concealed Hinge.".

*Primary Examiner*—Chuck Y. Mah
*Attorney, Agent, or Firm*—Paul & Paul

[57] ABSTRACT

A hinge is provided having an interior pivot point and an exterior pivot point for mounting a door to a frame such that the door is capable of opening a full one hundred eighty degrees. The hinge has a lower bracket having mounted on the frame, a central pivot link rotationally attached to the lower bracket, an exterior pivot pin extending between the lower bracket and the central pivot link providing for rotational movement of the pivot link with respect to the lower bracket, an upper bracket mounted on a door, and an interior pivot pin, parallel to the exterior pivot pin, extending between the upper bracket and the central pivot link providing for rotational movement of the door with respect to the central pivot link.

12 Claims, 7 Drawing Sheets

DUAL PIVOT HINGE ASSEMBLY

BACKGROUND OF THE INVENTION

This invention pertains to the art of hinges and more particularly to an improvement in hinges wherein the hinge has two separate pivot points, yielding a unique geometry.

The invention is particularly applicable to hinges for enclosures with doors where issues of clearance of the door with respect to the cabinet are critical where it is desired to open the enclosure door to one hundred eighty degrees or more. The principal object of the invention is to provide a hinge that is capable of opening one hundred eighty degrees or more using two separate pivot points in a single hinge.

SUMMARY OF THE INVENTION

It is accordingly an object of the present invention to provide a new and improved hinge that has the capability to open a door on a cabinet a full one-hundred eighty degrees by providing two pivot points: a first pivot point to swing the door out to, for example, ninety degrees, and a second pivot point, linked to the first pivot point, to allow the door to pivot a full one hundred eighty degrees.

The dual pivot hinge of the present invention comprises a lower bracket having mounting means to mount the lower bracket on a door frame, a central pivot link rotationally attached to the lower bracket, an exterior pivot pin extending between the lower bracket and the central pivot link providing for rotational movement of the pivot link with respect to the lower bracket, an upper bracket having mounting means to mount the upper bracket on a door, and an interior pivot pin, parallel to said exterior pivot pin, extending between the upper bracket and the central pivot link providing for rotational movement of the door with respect to the central pivot link.

It is another object of the present invention to provide a new and improved hinge that provides a full one hundred eighty degrees of travel, using two pivot points, that mounts on the outside of a cabinet frame.

It is another object of the present invention to provide a new and improved hinge that provides a full one hundred eighty degrees of travel, using two pivot points, that has at least one detent point where the door is held in a closed position and optionally one or more opened positions.

It is a further object of the present invention to provide a new and improved hinge that provides a full one hundred eighty degrees of travel, using two pivot points, that allows the door to smoothly open to full rotation.

Other objects and advantages of the present invention will become apparent from the following description taken in conjunction with the accompanying drawings.

DESCRIPTION OF THE PREFERRED EMBODIMENT

Figure 1:
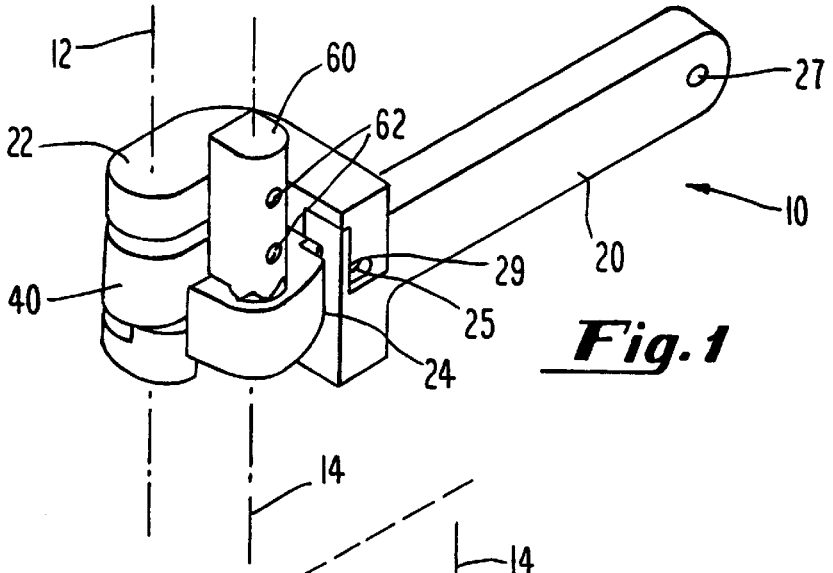
FIG. 1 is a perspective view of the dual pivot hinge assembly of one embodiment of the present invention, with the hinge in the closed position.

Referring now in detail to the drawings, wherein like reference numerals indicate like elements throughout the several views, there is shown in FIGS. 1 a dual pivot hinge assembly 10 in accordance with a preferred embodiment of the present invention.

The dual pivot hinge assembly 10 of one preferred embodiment of the present invention has five major functional components: a lower bracket 20, a central pivot link 40, an upper bracket 60, an upper pivot pin 70, and lower pivot pin 80.

The dual pivot hinge assembly 10 has two pivot points, an interior pivot point 14 preferably positioned adjacent a door of a cabinet, and an exterior pivot point 12 preferably positioned adjacent the frame 16 of the cabinet. The lower mounting bracket 20 connects the hinge assembly 10 to a cabinet 16, while mounting means 62 on an upper mounting bracket 60 integral to upper pivot pin 70 connects the mounting bracket 60 of pivot pin 70 to the cabinet door 15 (See FIGS. 16–20). In addition, the dual pivot hinge includes a central pivot link 40 pivotally located between each of the two pivot points 12 and 14. The central pivot link 40 is pivotally attached to both the upper mounting bracket 60 and the lower mounting bracket 20 by upper pivot pin 70 and lower pivot pin 80 respectively such that the upper pivot pin 70 acts to swing the central pivot link 40 and therefore the cabinet door 15 around the exterior pivot point 12. The lower pivot pin 80 allows the central pivot link 40 to be moved rotationally about the exterior pivot point 12 for a set rotational amount of freedom.

Upon assembly, the lower mounting bracket 20 which is associated with the exterior pivot point 12 is mounted to the frame of the cabinet 16. The upper pivot pin 70 which is the actual hinge point for the interior pivot point 14, is mounted to a flange or edge of the cabinet door 15.

Lower mounting bracket 20 may be mounted on a door frame 16 using mounting means such as holes 25, 27.

In operation, the interior pivot point 14 and exterior pivot point 12 are each limited in rotational freedom by various stop means to, for example, 90 degrees, so that the total amount of rotation of the device is, for example, 180 degrees. In alternative embodiments, the pivot points may each allow for a greater or lesser amount of rotation than the 90 degrees indicated above, such that any desired angle may be used. For example, the exterior pivot point 12 may be limited to rotate 30 degrees, while the interior pivot point 14 may be limited to rotate 70 degrees. Changing the amount of travel of rotation may effect the clearances of a door and hinge relative to a cabinet.

An important characteristic of the present invention is a cam feature which governs the proper sequence of pivoting the door 15 with respect to the cabinet 16. As the door 15 is opened from zero to ninety degrees, the exterior pivot point 12 rotates while the interior pivot point 14 remains stationary. Subsequently, when the door 15 is rotated from ninety degrees to one hundred eighty degrees, the interior pivot point rotates while the exterior pivot point remains stationary. Closing the door 15 entails the exact opposite motion: first the interior pivot point 14 rotates, then the exterior pivot point 12 rotates. As will be described below, cammed surfaces are shaped to be easier to rotate the door 15 in one direction than the other to accomplish this result. This could also be accomplished by a clutch or ratchet means.

The amount of rotation of each of the two pivot points 12, 14 are regulated by stop means associated with each of the two pivots points 12, 14. In the present invention, there is no stop means at the exterior pivot point, when the door 15 is fully closed, allowing the door to close completely, regardless of variations in gasketing or door/frame construction.

Figure 12:
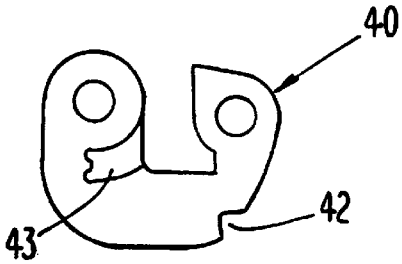
FIG. 12 is a bottom view of the central pivot link of the hinge assembly of FIG. 1.
Figure 13:
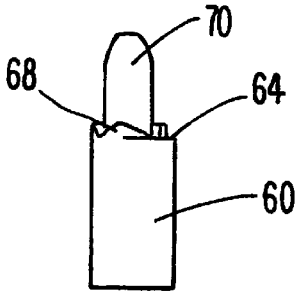
FIG. 13 is a right side view of a radially cammed interior pivot pin of the hinge assembly of FIG. 1.
Figure 14:
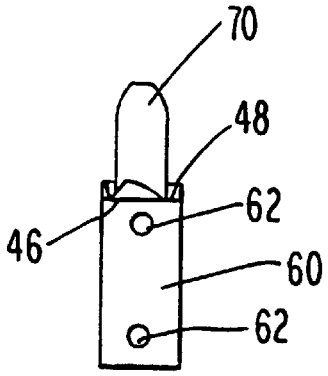
FIG. 14 is a back view of the radially cammed interior pivot pin of the hinge assembly of FIG. 1.
Figure 15:
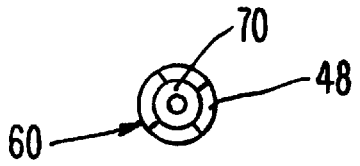
FIG. 15 is a top view of the radially cammed interior pivot pin of the hinge assembly of FIG. 1.

The stop means at the exterior pivot point 12, i.e. when the door 15 is opened ninety degrees, occurs at a point where an extension 26 provided on a lower surface of the lower bracket 20 interacts with a slot 43 formed in a lower surface of the central pivot link 40. See FIGS. 12 and 17.

Figure 16:
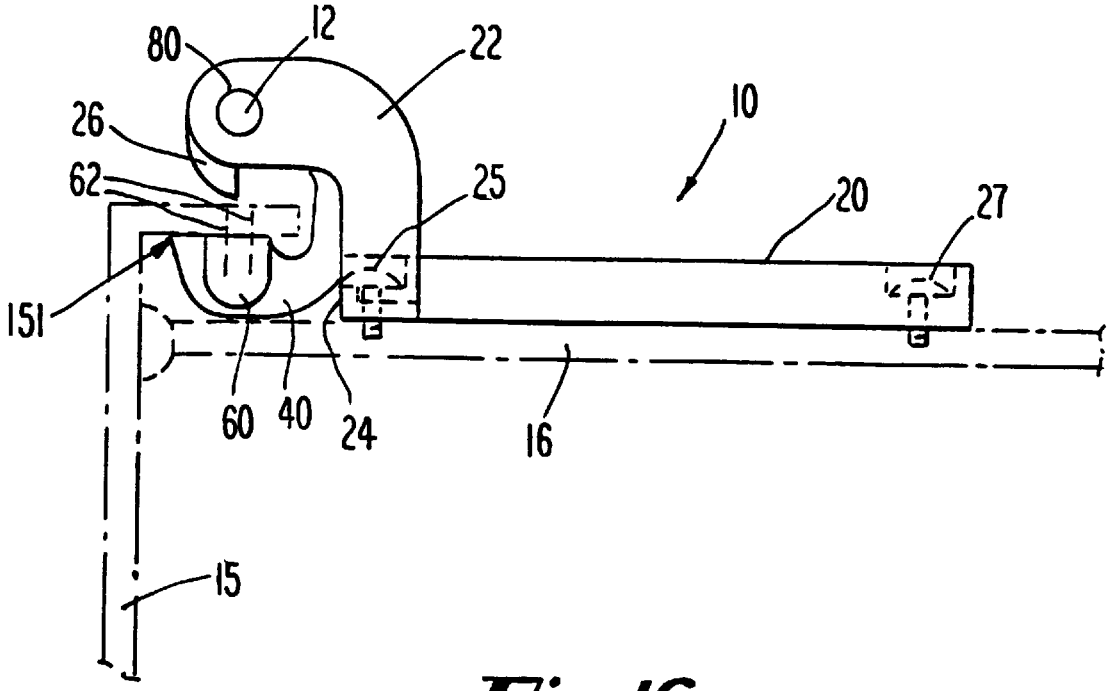
FIG. 16 is a top assembly view of the hinge assembly of FIG. 1 as mounted in a cabinet, depicting the cabinet and cabinet door in phantom lines, with the cabinet door in a closed position.
Figure 17:
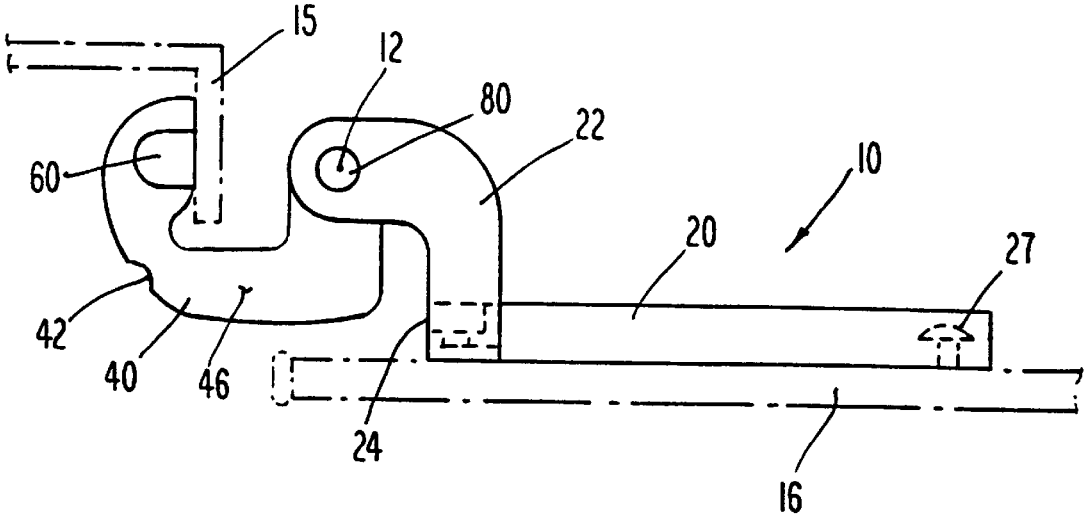
FIG. 17 is a top assembly view of the hinge assembly of FIG. 1 a mounted in a cabinet, depicting the cabinet and cabinet door in phantom lines, with the cabinet door in a first opened position with the door opened ninety degrees.
Figure 18:
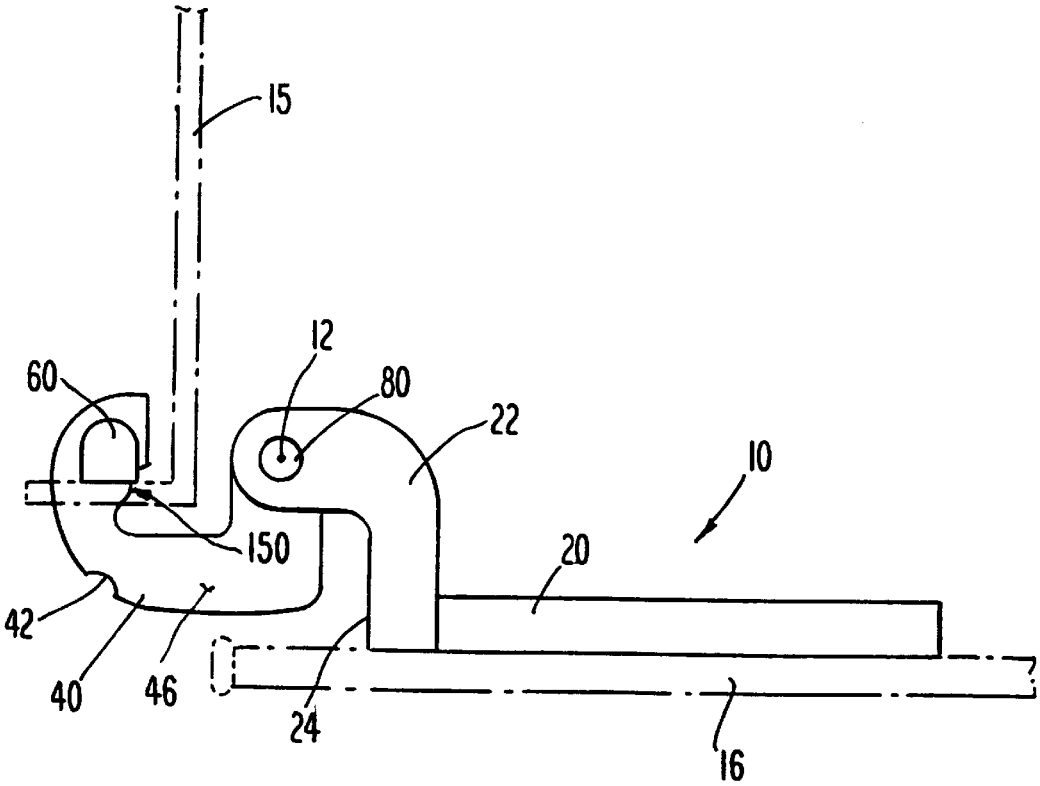
FIG. 18 is a top assembly view of the hinge assembly of FIG. 1 as mounted in a cabinet, depicting the cabinet and cabinet door in phantom lines, with the cabinet door in a second opened position with the door opened one hundred eighty degrees.
Figure 19:
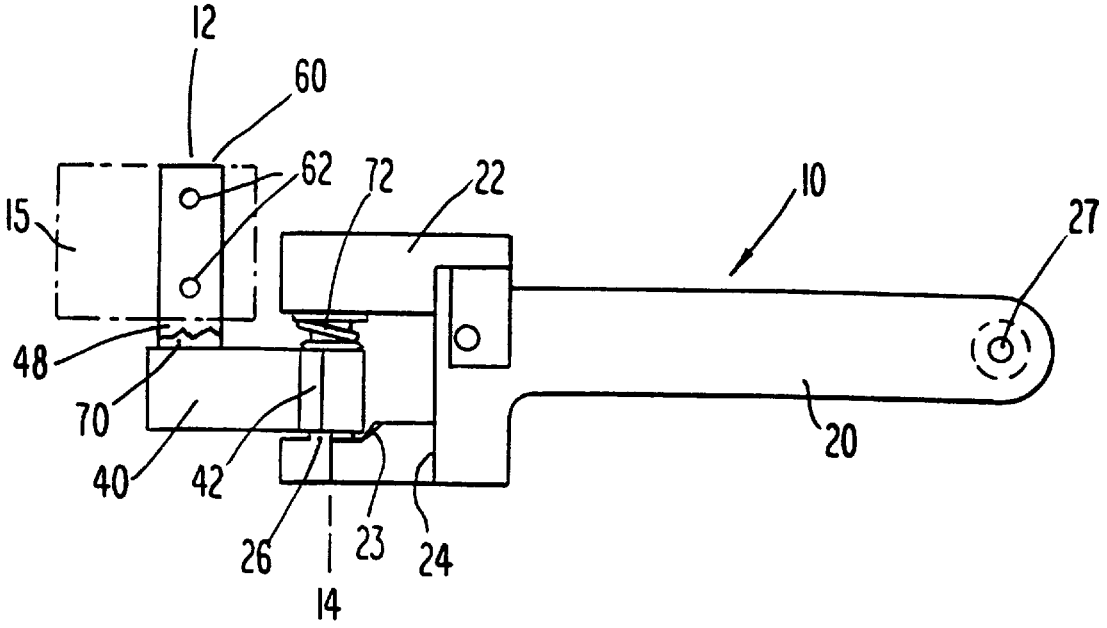
FIG. 19 is a front view of the hinge assembly of FIG. 1, with the cabinet door depicted in phantom lines in the second opened position.
Figure 20:
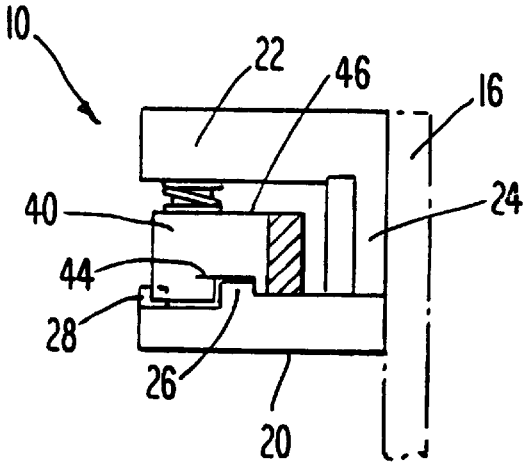
FIG. 20 is a left side view of the hinge assembly of FIG. 19 with the central pivot link shown partially cutaway and the radially cammed interior pivot pin not shown.
Figure 21:
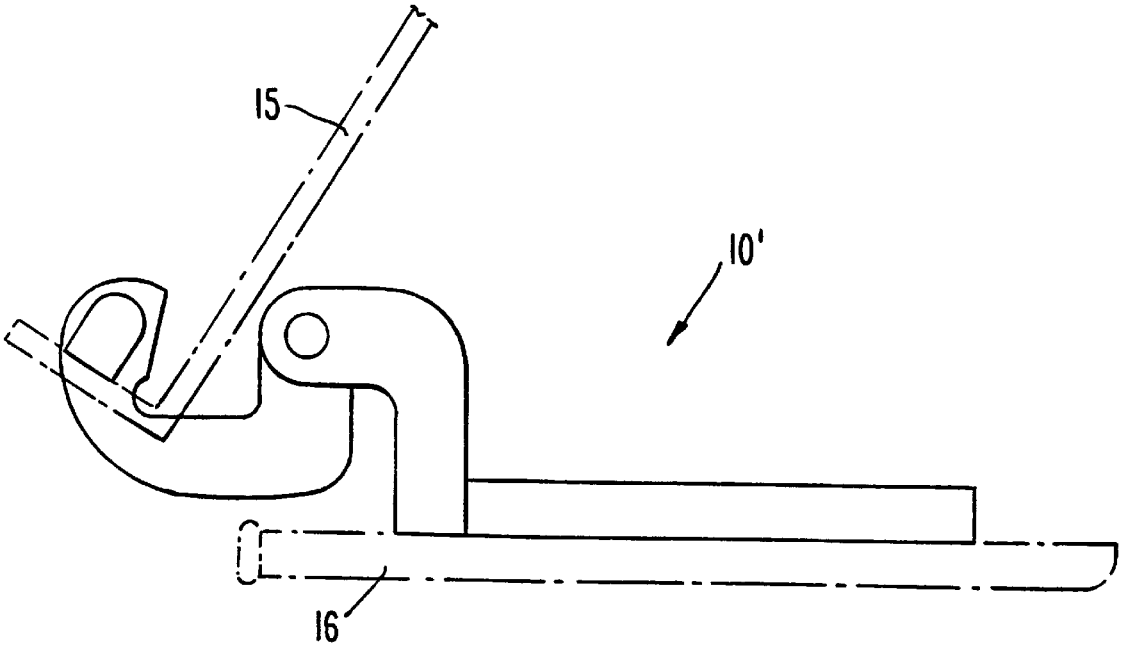
FIG. 21 is a top view of an alternate embodiment of the hinge assembly of FIG. 1, wherein the door may be opened greater than 180 degrees, depicted mounted on a cabinet in phantom lines with the cabinet door central pivot link shown in the opened position and the radially cammed interior pivot pin shown in a mid-way opened position, such that the cabinet door is opened 135 degrees.

The first stop on the interior pivot point, i.e. when the door 15 is opened to, for example, one hundred eighty degrees, is regulated by edge 150 of the central pivot link interacting with the edge of the door (FIG. 18). The second stop on the interior pivot point, i.e. when the door is closed to ninety degrees, is regulated by edge 151 interacting with the inside surface of the door (FIGS. 16 and 17). Also, in order to provide a detent means to hold the door open to, for example, ninety degrees and, for example, one hundred eighty degrees, the interior pivot point comprises a cammed interface between the upper pivot pin 70, located on the upper bracket 60 at the interior pivot point 14, and the central pivot link 40 at the interior pivot point 14. Structurally, the upper surface 46 of the link 40 and lower surface 64 of the upper bracket 60 attached to the upper pivot pin 70 each have a plurality of raised cammed lobes on a cammed surface 48, 68, preferably formed so that they are steep in one direction and shallow in the other direction. The plurality of cammed surfaces 68 adjacent the upper pivot pin 70 and a like number of cammed surfaces 48 on the central pivot link 40 allow the door 15 to "snap" into position, at for example two points that are ninety degrees apart. By design, in operation, it may be preferable to design these cammed surfaces 48, 68 to be more difficult, i.e. require more force, to rotate the cabinet door 15 at the interior pivot point 14, for example clockwise, in the direction of steep surfaces, and easier to rotate the cabinet door 15 at the interior pivot point 14 counterclockwise in the direction of shallow cammed surfaces. See FIGS. 17 and 18.

In operation, when the door 15 moves from a closed position (FIG. 16) to the ninety degree opened position (FIG. 17) by exterior pivot point 12 as described above, the door 15 is level until there is a rotation of the door 15 of slightly less than ninety degrees such that the door 15 is in a raised position in order to clear the cabinet frame 16. At approximately ninety degrees, the central pivot link 40 is moved slightly downward due to an angled step 28 on the lower bracket 20. The central pivot link 40 and therefore the cabinet door 15 are urged downward due to the weight of the cabinet door 15 and also due to an optional biasing means such as spring 72 mounted between the lower mounting bracket 20 and the central pivot link 40. This provides a detent position at ninety degrees. Thereafter, continued rotation of the door 15 occurs at the interior pivot point 14 which pushes the door 15 slightly up intermittently due to the cammed surfaces. In order to close the door 15, the opposite motion occurs. Additionally, the angled step 28 on the lower bracket 20 allows the door 15 to be closed since the link 40 will ride up on the angled surface of the step 28 by rotating the door 15, without having to physically lift up the door 15 by other means.

Figure 2:
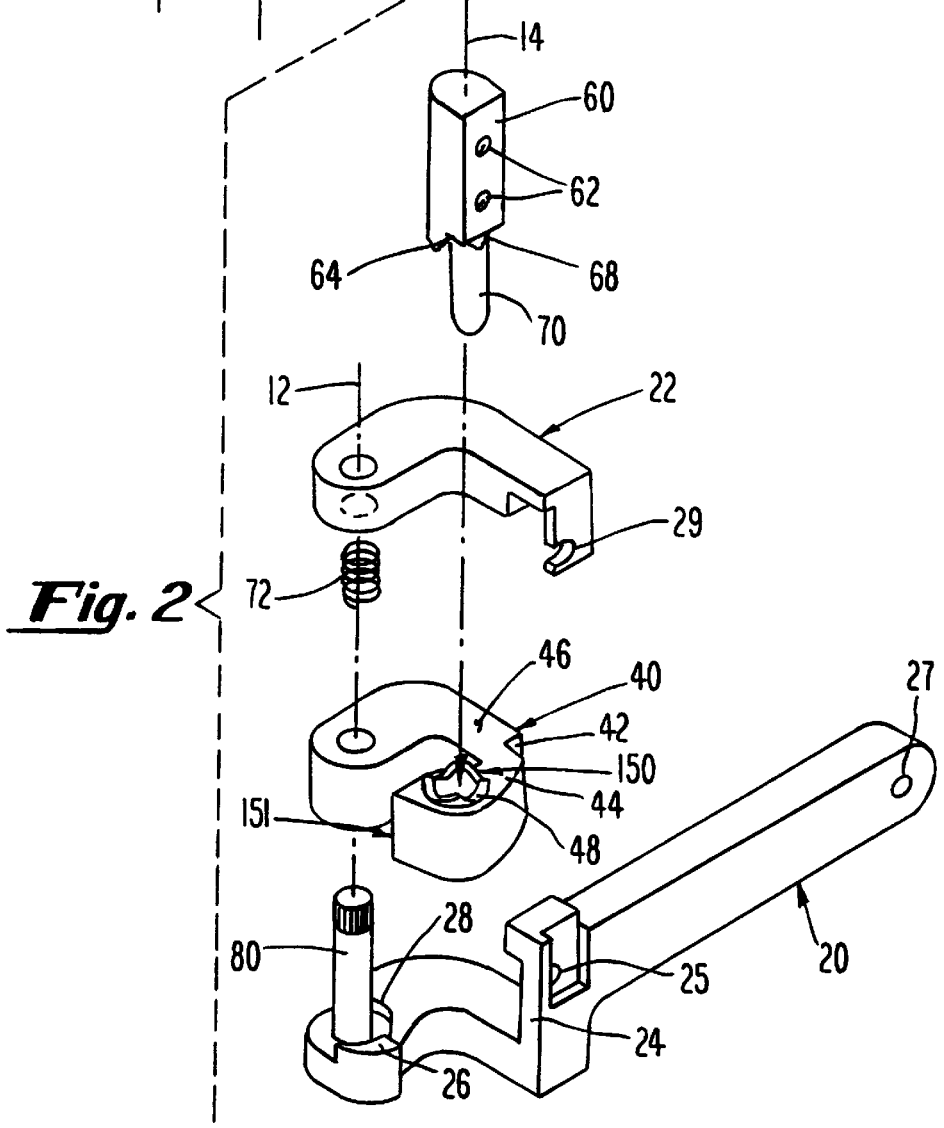
FIG. 2 is an exploded perspective view of the embodiment of FIG. 1.
Figure 3:
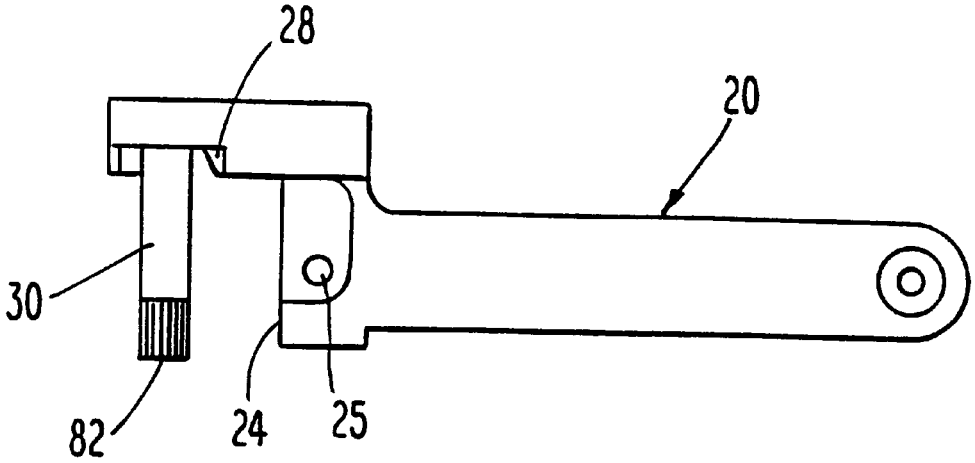
FIG. 3 is a back view of a lower bracket of the hinge assembly of FIG. 1.
Figure 4:
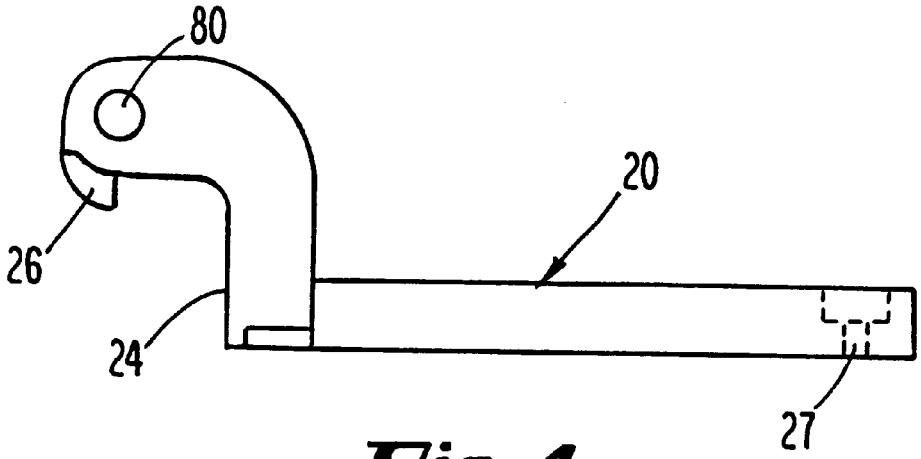
FIG. 4 is a top view of the lower bracket of the hinge assembly of FIG. 1.
Figure 5:
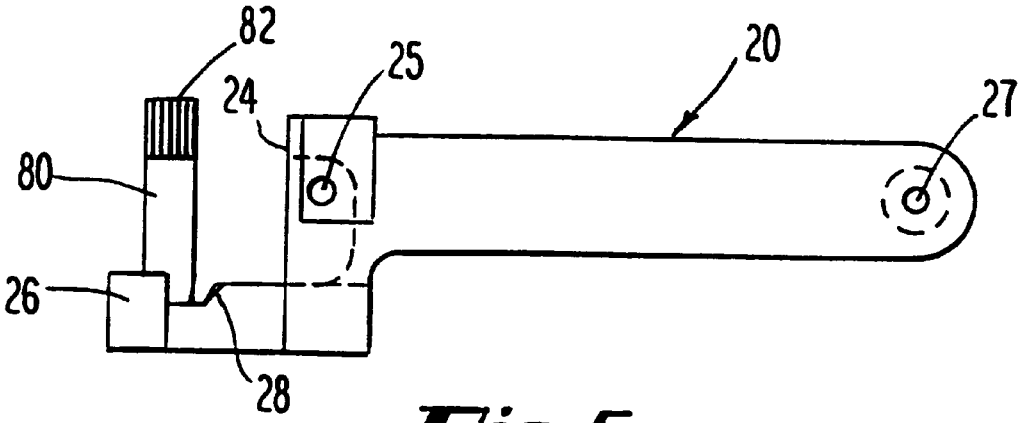
FIG. 5 is a front view of the lower bracket of the hinge assembly of FIG. 1.
Figure 6:
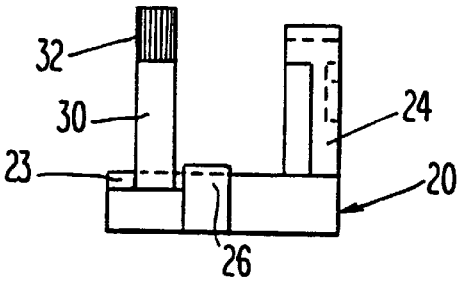
FIG. 6 is a left side view of the lower bracket of the hinge assembly of FIG. 1.
Figure 7:
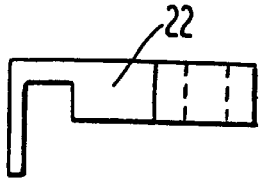
FIG. 7 is a right side view of an upper arm bracket of the hinge assembly of FIG. 1.
Figure 8:
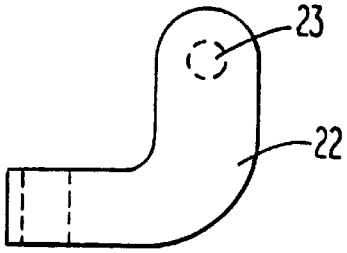
FIG. 8 is a top view of the upper arm bracket of the hinge assembly of FIG. 1.
Figure 9:
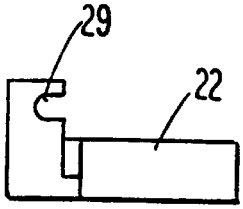
FIG. 9 is a front view of the upper arm bracket of the hinge assembly of FIG. 1.
Figure 10:
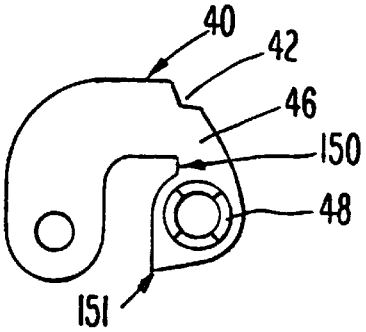
FIG. 10 is a top view of a central pivot link of the hinge assembly of FIG. 1.
Figure 11:
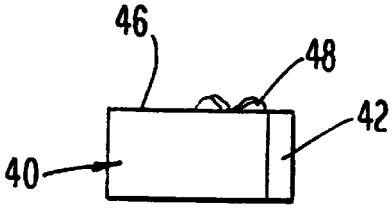
FIG. 11 is a left side view of the central pivot link of the hinge assembly of FIG. 1.

As described above, cammed features of the hinge 10 govern the proper sequence of pivoting the cabinet door 15 with respect to the cabinet frame 16. The motion is as follows: upon opening the door 15 zero to ninety degrees, the interface between the central pivot link 40 and the lower bracket 20 where the exterior pivot point 12 is located is a flat surface, allowing for easy rotation. The interface between the central pivot link 40 and the upper bracket 60 is a "steep" cam surface, so rotation occurs around the exterior pivot point 12 rather than the lower bracket 20, pivot point 14. Just before ninety degrees, the link 40 drops down a steep cam surface, angled step 28, so it will not tend to rotate backwards, and at ninety degrees, the exterior pivot point 12 comes to a positive stop. Further rotation of the door will cause the interior pivot point 14 to rise over its steep cam and proceed open to one hundred eighty degrees, where it is held by the detent inherent in the cam. Rotation past one hundred eighty degrees is prevented due to the interference between the central pivot link 40 and the door edge. When closing the door 15 from one hundred eighty to ninety degrees, the interior pivot point 14 rises over shallow cam 48, 68, while the exterior pivot point 12 is held in place by its steep cam slope, angled step 28. At ninety degrees, further rotation at the interior pivot point 14 is prevented by interference between the central pivot link 40 and the inside surface of the door 151 (FIGS. 2 and 16). From ninety degrees to zero degrees, the exterior pivot point is then forced to rise over its steep cam, because the interior pivot point 14 cannot rotate.

Variations can occur with respect to the amount of angle of the cammed surfaces, which are preferably primarily selected based on the weight of the door 15.

In a preferred embodiment of the dual pivot hinge assembly 10 of the present invention, the central pivot link 40 and optional spring 72 are rotatably attached to the lower mounting bracket 20 by a top member 22. As can be seen in FIGS. 1 and 2, top member 22 is may be screwed in place using slot through hole 25 (also may be used as a mounting hole) and pressed into place by knurling 82 into hole 23 on lower pivot pin 80 such that the central pivot link 40 and spring 72 are captivated on lower pivot pin 80, but are free to rotate. Central pivot link also is free to move longitudinally for a small distance on the lower pivot pin 80 and is urged down by spring 72. Therefore, only upper pivot pin 70 integral to upper bracket 60 is separate hardware. All other elements of hinge 10 are a single assembly.

Figure 22:
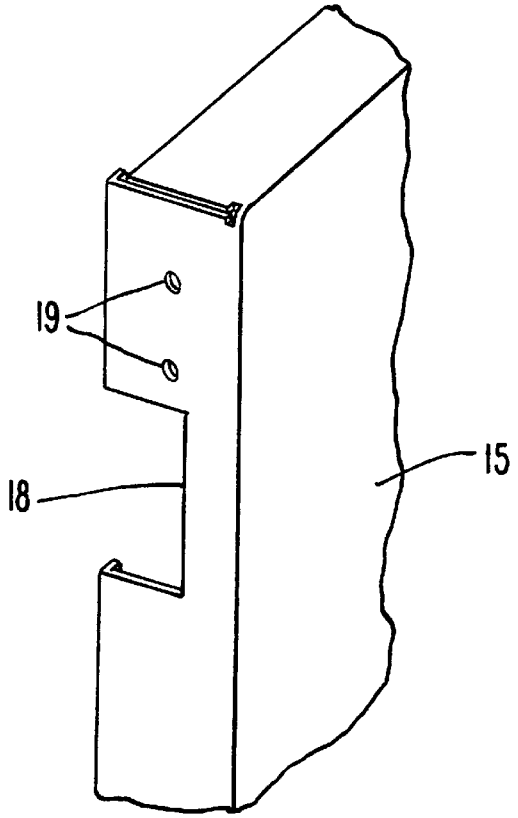
FIG. 22 is a partial perspective view of a door to be used wit hinge invention of FIG. 1 showing a cut-out for proper hinge clearance.

Finally, FIG. 22 depicts cabinet door 15 having special cut-out 18, designed to give proper clearance for the hinge 10 of the present invention. Mounting holes 19 are shown which mount to upper mounting bracket 60.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. A hinge having an interior pivot point and an exterior pivot point for mounting a door to a frame, comprising:

a) a lower bracket having mounting means to mount the lower bracket on the frame;

b) a central pivot link rotationally attached to the lower bracket;

c) an exterior pivot pin extending between the lower bracket and the central pivot link providing for rotational movement of the pivot link with respect to the lower bracket around the exterior pivot point;

d) an upper bracket having mounting means to mount the upper bracket on the door;

e) an interior pivot pin, parallel to said exterior pivot pin, extending between the upper bracket and the central pivot link providing for rotational movement of the door with respect to the central pivot link around the interior pivot point f) an interior pivot detent means for providing at least one detent position for the upper bracket with respect to the central pivot link, the interior pivot detent means including a cammed surface, the cammed surface having a plurality of cam lobes located integral to the upper bracket adjacent and radially around the interior pivot pin; and g) a central pivot detent mating cammed surface, having a like plurality of mating cam lobes to the interior pivot detent means, located integral to the central pivot link and radially around the interior pivot pin.

2. The hinge of claim 1, including exterior pivot detent means for providing at least one detent position located for the central pivot link with respect to the lower bracket.

3. The hinge of claim 2, including biasing means for urging the central pivot link against the lower bracket whereby increased longitudinal load is placed on the central pivot link against the lower bracket.

4. The hinge of claim 1, including exterior pivot detent means for providing at least one detent position located where the central pivot link is rotated to a fully extended position relative to the lower bracket.

5. The hinge of claim 1, including at least one rotation stop point that limits rotational movement of the central pivot link with respect to the lower bracket.

6. A hinge having an interior pivot point and an exterior pivot point for mounting a door to a frame, comprising:

a) a lower bracket having mounting means to mount the lower bracket on the frame;

b) a central pivot link rotationally attached to the lower bracket;

c) an exterior pivot pin extending between the lower bracket and the central pivot link providing for rotational movement of the pivot link with respect to the lower bracket around the exterior pivot point;

d) an upper bracket having mounting means to mount the upper bracket on the door;

e) an interior pivot pin, parallel to said exterior pivot pin, extending between the upper bracket and the central pivot link providing for rotational movement of the door with respect to the central pivot link around the interior pivot point;

f) exterior pivot detent means for providing at least one detent position located where the central pivot link is rotated to a fully extended position relative to the lower bracket;

g) interior pivot detent means for providing at least one detent position for the upper bracket with respect to the central pivot link; and h) biasing means for urging the central pivot link against the lower bracket whereby increased load along the axis of the exterior pivot pin is placed on the central pivot link against the lower bracket.

7. The hinge of claim 6, including at least one rotation stop point that limits rotational movement of the central pivot link with respect to the lower bracket.

8. The hinge of claim 6, wherein the interior pivot detent means including a cammed surface, the cammed surface having a plurality of cam lobes located integral to the upper bracket adjacent and radially around the interior pivot pin and also including a mating cammed surface, having a like plurality of cam lobes located integral to the central pivot link and radially around the interior pivot pin.

9. A hinge having an interior pivot point and an exterior pivot point for mounting a door to a frame, comprising:

a) a lower bracket having mounting means to mount the lower bracket on the frame;

b) a central pivot link rotationally attached to the lower bracket;

c) an exterior pivot pin extending between the lower bracket and the central pivot link providing for rotational movement of the pivot link with respect to the lower bracket around the exterior pivot point;

d) an upper bracket having mounting means to mount the upper bracket on the door;

e) an interior pivot pin, parallel to said exterior pivot pin, extending between the upper bracket and the central pivot link providing for rotational movement of the door with respect to the central pivot link around the interior pivot point;

f) exterior pivot detent means for providing at least one detent position located where the central pivot link is rotated to a fully extended position relative to the lower bracket;

g) interior pivot detent means for providing at least one detent position for the upper bracket with respect to the central pivot link;

h) biasing means for urging the central pivot link against the lower bracket whereby increased load is placed on the central pivot link against the lower bracket;

i) at least one rotation stop point that limits rotational movement of the central pivot link with respect to the lower bracket; and j) wherein the interior pivot detent means includes a cammed surface, the cammed surface having a plurality of cam lobes located integral to the upper bracket adjacent and radially around the interior pivot pin and also includes a mating cammed surface, having a like plurality of cam lobes located integral to the central pivot link and radially around the interior pivot pin.

10. A hinge having an interior pivot point and an exterior pivot point for mounting a door to a frame, comprising:

a) a lower bracket having mounting means to mount the lower bracket on the frame;

b) a central pivot link rotationally attached to the lower bracket;

c) an exterior pivot pin extending between the lower bracket and the central pivot link providing for rotational movement of the pivot link with respect to the lower bracket around the exterior pivot point;

d) an upper bracket having mounting means to mount the upper bracket on the door;

e) an interior pivot pin, parallel to said exterior pivot pin, extending between the upper bracket and the central pivot link providing for rotational movement of the door with respect to the central pivot link around the interior pivot point; and f) biasing means for urging the central pivot link against the lower bracket whereby increased load, along the axis of the exterior pivot pin, is placed on the central pivot link against the lower bracket.

11. A hinge having an interior pivot point and an exterior pivot point for mounting a door to a frame, comprising:

a) a lower bracket having mounting means to mount the lower bracket on the frame;

b) a central pivot link rotationally attached to the lower bracket;

c) an exterior pivot pin extending between the lower bracket and the central pivot link providing for rotational movement of the pivot link with respect to the lower bracket around the exterior pivot point;

d) an upper bracket having mounting means to mount the upper bracket on the door;

e) an interior pivot pin, parallel to said exterior pivot pin, extending between the upper bracket and the central pivot link providing for rotational movement of the door with respect to the central pivot link around the interior pivot point;

f) exterior pivot detent means for providing at least one detent position located where the central pivot link is rotated to a fully extended position relative to the lower bracket;

g) interior pivot detent means for providing at least one detent position for the upper bracket with respect to the central pivot link, the interior pivot detent means including a cammed surface, the cammed surface having a plurality of cam lobes located integral to the upper bracket adjacent and radially around the interior pivot pin and also including a mating cammed surface, having a like plurality of cam lobes located integral to the central pivot link and radially around the interior pivot pin; and h) biasing means for urging the central pivot link against the lower bracket whereby increased load is placed on the central pivot link against the lower bracket.

12. The hinge of any one of claims 1, 6, 9, 10, or 11, including camming means to compel the exterior pivot point to fully rotate for the entire travel of the exterior pivot point prior to the interior pivot permitting motion when the door is opened and that compels the interior pivot point to fully rotate for the entire travel of the interior pivot point prior to the exterior pivot point permitting motion when the door is closed.

* * * * *